United States Patent [19]

Schrooten

[11] Patent Number: 4,872,572

[45] Date of Patent: Oct. 10, 1989

[54] LYOPHILIZATION STOPPER (CASE II)

[75] Inventor: Rik Schrooten, Kleine Brogel, Belgium

[73] Assignee: Helvoet Pharma N.V., Alken, Belgium

[21] Appl. No.: 288,972

[22] Filed: Dec. 23, 1988

[30] Foreign Application Priority Data

Dec. 24, 1987 [DE] Fed. Rep. of Germany ..... 3744174

[51] Int. Cl.[4] ..... B65D 51/16

[52] U.S. Cl. ..... 215/307; 215/247; 215/310; 215/355; 215/357

[58] Field of Search ..... 215/307, 310, 355, 247, 215/357, 358, 362, 363

[56] References Cited

U.S. PATENT DOCUMENTS

| | | | |
|---|---|---|---|
| 1,375,471 | 4/1921 | Sherman | 215/247 |
| 2,927,709 | 3/1960 | Hoffman et al. | 215/307 X |
| 3,834,571 | 9/1974 | Bartell | 215/307 X |
| 4,193,402 | 3/1980 | Rumpler | 215/307 X |
| 4,286,389 | 9/1981 | Ogle | 215/307 X |
| 4,293,078 | 10/1981 | Percarpio et al. | 215/355 X |
| 4,355,111 | 10/1982 | Shimizu et al. | 215/310 X |

FOREIGN PATENT DOCUMENTS

| | | | |
|---|---|---|---|
| 1255197 | 1/1961 | France | 215/307 |

*Primary Examiner*—Stephen Marcus
*Assistant Examiner*—Christine A. Peterson
*Attorney, Agent, or Firm*—Spencer & Frank

[57] ABSTRACT

A lyophilization stopper made of a rubber elastic material is composed of a shank (1) and a circular disc shaped flange (2) made in one piece with the shank. The shank includes a cavity (4) which surrounds the longitudinal axis (A) of the shank and is open toward the free end face (3) of the shank, while extending toward a central closed wall portion (**2*b*) of the flange. A first section ($Z_1$) of the shank disposed between a first transverse plane ($Q_1$) and a second transverse plane ($Q_2$) has a closed outer circumferential face which has a maximum diameter (D). A subsequent second section ($Z_2$) includes a passage which communicates with the cavity as well as a plurality of projecting blocking elements (14*a*–14*c*). The inner wall surface (19) which laterally delimits the cavity (4**) and has an increasing diameter with increasing approach to the free shank end face lies completely outside a cone (K) whose axis is the longitudinal axis (A) of the shank, whose tip ($K_1$) lies in the transverse plane ($Q_1$) and whose tip angle ($\beta$), in degrees, is larger than a value calculated according to the formula $$-39+75\times\lg(D),$$

where "D" is the maximum diameter (D) of the first section ($Z_1$) measured in millimeters. In this way, a particularly utilitarian stopper is obtained which does not interfere with the insertion of the hollow extraction needle.

7 Claims, 2 Drawing Sheets

Figure 1:
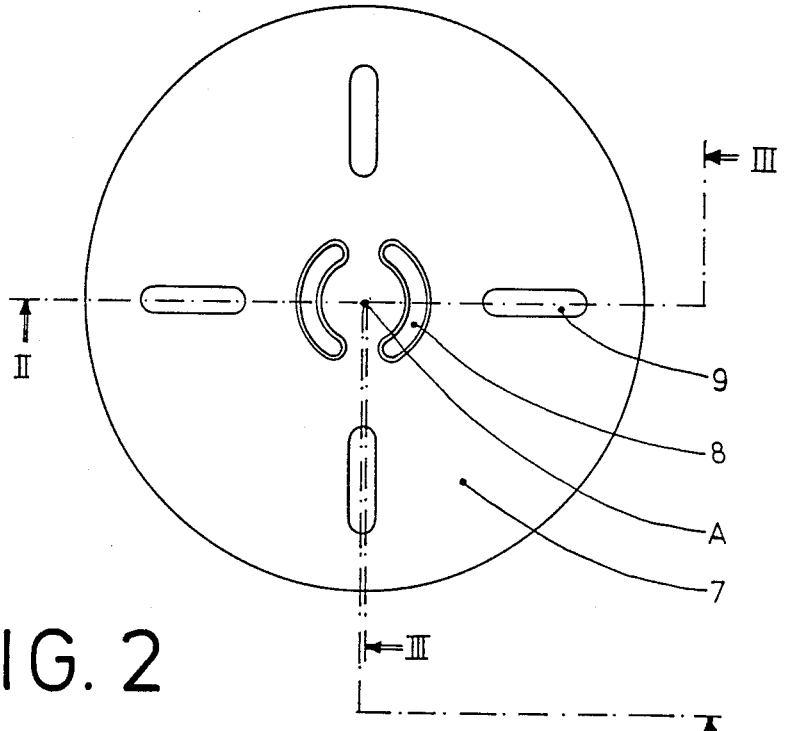

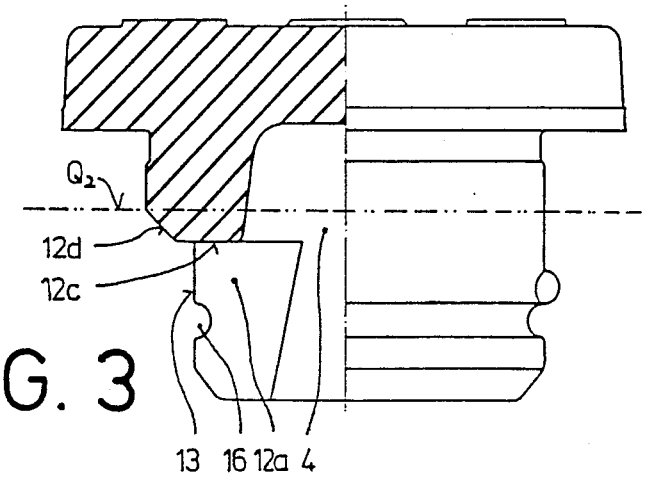
FIG. 3
FIG. 4
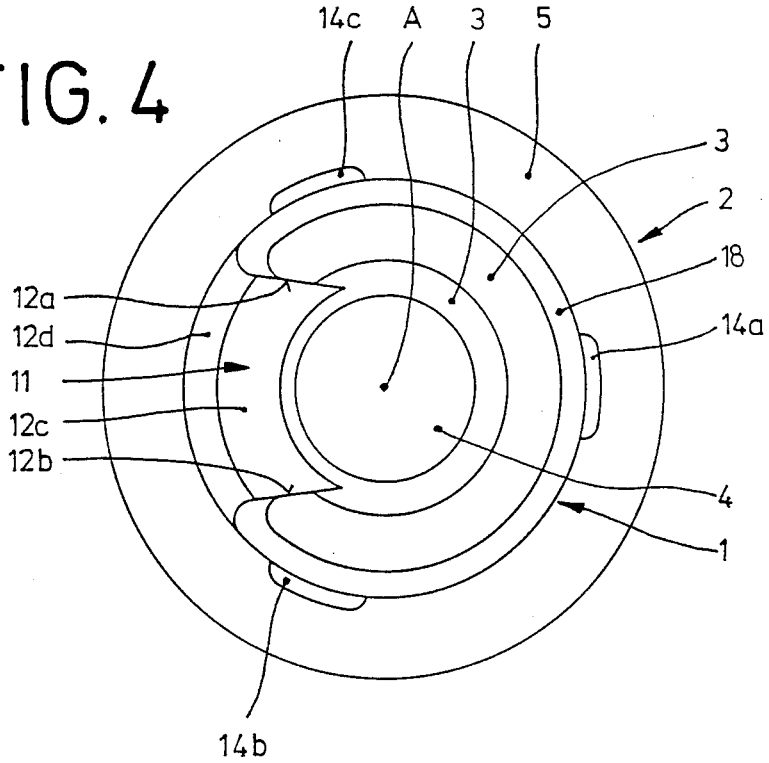

LYOPHILIZATION STOPPER (CASE II)

The invention relates to a lyophilization stopper made of a rubber elastic material and composed of a shank intended for insertion into the container neck to be sealed and of an essentially circular disc shaped flange which is made in one piece with the shank and projects radially beyond it. The longitudinal axis of the flange is congruent with the longitudinal axis of the shank. The shank includes a cavity which surrounds the longitudinal axis of the shank, is open toward the free end face of the shank and extends up to a centrally closed wall portion of the flange. Over its axial length, the shank includes a first section which extends between a first transverse plane defined by the boundary face of the flange projecting radially outwardly from the shank and a second transverse plane perpendicular to the longitudinal axis of the shank. This first section has a closed outer circumferential face whose maximum diameter is slightly larger than the inner diameter of the container neck. Following the first section, the shank has a second section having an outer enveloping face which has essentially the same diameter as the first section and includes at least one passage communicating with a cavity extending from the end face of the shank to a radial opening disposed in the second section adjacent the second transverse plane. A plurality of blocking elements, which can be pushed back by elastic deformation, project outwardly from the second section beyond the enveloping face, with their axially outer boundaries lying on a common third transverse plane perpendicular to the longitudinal axis of the shank and disposed between the second transverse plane and the free end face of the shank perpendicularly to the longitudinal axis of the shank.

In a prior art lyophilization stopper of this type, the shank is an essentially tubular body having an almost constant wall thickness over practically its entire length, i.e. the laterally delimiting inner wall face of its central cavity is approximately a cylindrical face. Also known are lyophilization stoppers in which only the first section of the axial shank length adjacent the flange has the shape of a tubular body. A plurality of mutually spaced pins project from the end face of this body, with their axes oriented parallel to the longitudinal axis of the shank and their diameters corresponding approximately to the wall thickness of the body. A repressible blocking element, or a blocking element which can be brought out of engagement by bending the pin, projects from each one of these pins.

Frozen [sic] material (particularly a medical preparation) contained in a container and sealed by the abovedescribed stopper is generally removed in that a hollow needle pierces the flange of the stopper and a liquid is introduced into the container, with the solution, or suspension, being removed by means of the hollow needle while the stopper is held downwardly. If the hollow needle is not applied precisely centrally in the middle of the flange and is not inserted practically parallel to the longitudinal axis of the shank, there exists the danger that the tip of the hollow needle will hit the side of the inner wall face, causing the needle to become clogged or particles of the shank material to be punched out. Another drawback is that with the prior art stoppers, a considerable residual volume of solution, or suspension, which cannot be removed by the needle remains in the container.

It is an object of the invention to modify a lyophilization stopper of the above-mentioned type so that the likelihood of the needle tip contacting the lateral inner wall face is reduced greatly and less care is required in inserting the needle and that the stopper also meets other requirements placed on a lyophilization stopper, particularly with respect to low residual volume, economical manufacture, sufficient tightness and easy manipulatability in the course of the freeze-drying process. This is accomplished according to the invention in that the inner wall face laterally delimiting the cavity is disposed entirely outside of a cone whose axis is the longitudinal axis of the shank, whose tip lies in the first transverse plane and whose tip angle, in degrees, is larger than a value calculated according to the formula $$-39+75\times\lg(D),$$

where "lg" in the formula represents the decimal logarithm and "D" the maximum diameter of the first shank section, measured in millimeters.

According to a preferred feature of the invention, the inner wall face of the central wall portion of the flange which axially delimits the cavity is essentially planar in a surface region surrounding the longitudinal axis of the shank, with this surface region lying in a transverse plane that is perpendicular to the longitudinal axis of the shank and extends near the first transverse plane. The inner wall face which laterally delimits the cavity starts at the surface region surrounding the longitudinal axis of the shank and has an increasing diameter with increasing approach to the free shank end face.

Advantageously, the surface region of the central wall portion of the flange surrounding the longitudinal axis of the shank is delimited against the remaining peripheral surface region by a circular arrangement of projections concentric with respect to the longitudinal axis of the shank, so as to mark the point of insertion for the hollow needle and, in conjunction with the configuration of the inner wall face of the shank according to the invention, providing even greater reliability in manipulation.

Figure 2:
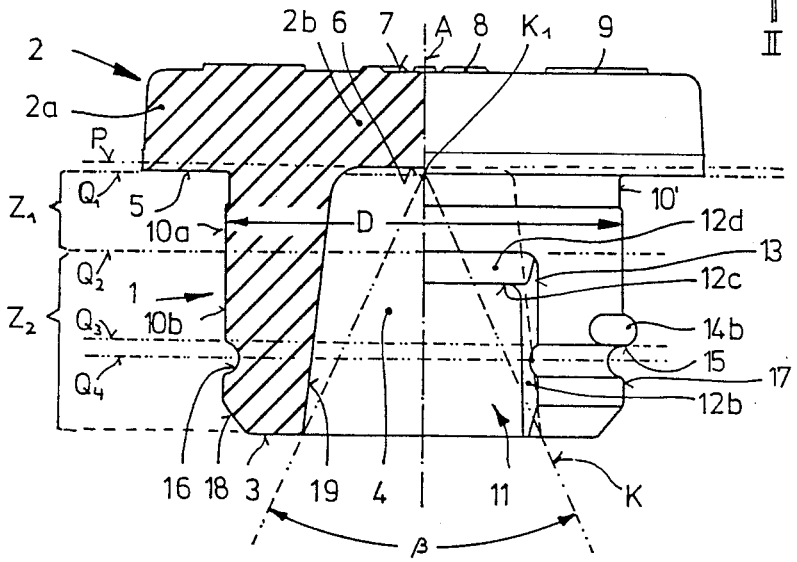

Further features and advantages of the invention are evident from the claims and the non-limiting description below of an embodiment of the invention illustrated in the drawings. The drawing figures show in:

FIG. 1, a top, view to an enlarged scale, of the upper side of a lyophilization stopper;

FIG. 2, a side view, partially in section and to an enlarged scale, of the lyophilization stopper seen along line II—II of FIG. 1;

FIG. 3, another side view, partially in section and to an enlarged scale, of the lyophilization stopper seen along line III—III of FIG. 1; and FIG. 4, a top view, to an enlarged scale, of the underside of the lyophilization stopper.

In FIGS. 1 to 4, the lyophilization stopper is shown approximately five times enlarged. It is composed of rubber and includes a shank 1 intended for insertion into the container neck to be sealed and a flange 2 made in one piece with the shank. Aside from its special configuration to be described below, shank 1 has basically the shape of a hollow cylinder which surrounds a cavity 4 open toward the free shank end face 3.

Flange 2 has an edge 2*a* which projects laterally beyond shank 1. A lower planar annular delimiting face 5 which extends radially outwardly from the shank is formed at edge 2*a*. This delimiting face lies in a first transverse plane $Q_1$ through which passes perpendicularly the longitudinal axis A of the shank, is intended to lie against the end face of the container neck and limits the insertion depth of the shank in its sealing position. The closed central wall portion 2b of flange 2 axially delimits cavity 4 by means of its inner wall face 6 which is planar in an areal region surrounding the longitudinal axis A of the shank and lies in a transverse plane P extending at a slight distance from first transverse plane $Q_1$. The outer face 7 of flange 2 facing away from shank 1 is provided with two approximately semicircular projections 8 whose diameter is small relative to the outer diameter of the flange and which mark a surface region surrounding the longitudinal axis A of the shank. Further projections 9 extend from the surface region of outer face 7 surrounding projections 8 radially to the longitudinal axis A of the shank and at the same angular spacings so as to prevent that lyophilization stoppers whose outer faces contact one another adhere to one another or to other objects and thus interfere with their processing.

In a first section $Z_1$ of its axial length extending between the first transverse plane $Q_1$ and a second transverse plane $Q_2$, which is perpendicular to the longitudinal axis A of the shank and, in a rough approximation, divides the length of the shank in half, shank 1 is given solid walls, i.e. it has a closed outer upper circumferential face 10a. This circumferential face is formed of a narrow and flat annular recess 10' adjacent the first transverse plane $Q_1$ and of an axially longer cylindrical face following thereafter, with the latter having a diameter D which is somewhat larger than the inner diameter of the container neck and lies sealingly against the container neck with elastic tension once the stopper has been inserted completely.

A second section $Z_2$ of the axial length of shank 1 extending from the second transverse plane $Q_2$ to the free end face 3 of the shank includes an outer cylindrical enveloping surface 10b which has essentially the same diameter D as upper circumferential face 10a. A passage 11 extends through the second section $Z_2$ from cavity 4 to an essentially rectangular opening 13, when developed, at the enveloping surface (circumferential face) 10b. Passage 11 has the shape of a slit and includes two side faces 12a, 12b which are essentially planar and extend almost parallel to the longitudinal axis A of the shank. From cavity 4 toward opening 13, these side faces become wider and have a mutual spacing between their centers which approximately corresponds to the diameter in the center of the cavity. A first inner portion 12c of the bottom face of passage 11 lies in a plane which is parallel to second transverse plane $Q_2$ and is offset relative thereto by a small amount toward shank end face 3. The inner portion 12c is followed by an outer portion 12d of the bottom face in the form of a sector of a cone frustum which, at its edge lying in the second transverse plane $Q_2$ and forming a component of opening 13, changes to circumferential face 10b.

Three bosses 14a to 14c, which are shaped in one piece with the shank, project from the circumferential face 10b of the second section $Z_2$ of the shank, with the axially outward boundaries 15 of the bosses (i.e. adjacent the end face of the shank) all lying in a common third transverse plane $Q_3$ which extends perpendicular to the longitudinal axis A of the shank and lies approximately in the middle between the second transverse plane $Q_2$ and the end face 3 of the shank.

If shank 1 is introduced into a container neck, bosses 14a to 14c, whose delimitations 15 lie against the end face of the container neck, constitute an impediment and define a first position of the stopper in which the latter is already held in a force locking manner in the container neck due to elastic deformation of the shank section adjacent the end face of the shank. However, through passage 11 the interior of the container is still open toward the environment. Thus, during the lyophilization process, vapors and gases from the material in the container are able to escape into the environment of the container. With increased exertion of force on the stopper, bosses 14a to 14c are urged backwards, with the bosses themselves and the material of shank 1 surrounding them being deformed. Then, the shank can be inserted into the container neck to a second position (sealing position) defined by contact of the delimiting face 5 of flange 2 at the end face of the container neck and in which the first section $Z_1$ of the shank equipped with the closed upper circumferential face 10a produces a complete seal in the container neck.

Bosses 14a to 14c each have the shape of elongate beads whose cross section is approximately semicircular and which extend in the circumferential direction of shank 1. The length of the bosses in that direction is at least 2.5 times their axial extent. A first boss 14a is disposed diametrally opposite the passage (slit) 11 in such a way that its center lies in a first longitudinal plane $L_1$ which includes the longitudinal axis A of the shank and passes through the middle between side faces 12a and 12b of passage 11. The centers of the other two bosses 14b and 14c are defined by a second longitudinal plane $L_2$ and a third longitudinal plane $L_3$, respectively, which include the longitudinal axis A of the shank, are disposed on different sides of the first longitudinal plane $L_1$ and enclose therewith identical angles $\alpha_2$ and $\alpha_3$ of approximately 110°. (degrees).

In a fourth transverse plane $Q_4$ which is perpendicular to the longitudinal axis A of the shank, there is disposed a groove 16 in such a manner that its inner side wall (i.e. the side wall adjacent flange 2) lies in the third transverse plane $Q_3$.

Groove 16 is followed by a circumferential face 17 of shank 1 whose diameter is slightly larger than the diameter of the circumferential face from which bosses 14a to 14c project. By way of a conical face 18 serving to facilitate insertion of shank 1 into the neck of the container, the circumferential face follows the end face of the shank.

The inner wall face 6 which axially delimits the cavity 4 of shank 1 changes, by way of a rounded chamfer, into a laterally delimiting inner wall face 19 which has the shape of a cone frustum whose axis is the longitudinal axis A of the shank and which has its largest diameter at the end face 3 of the shank. The significant factor for the configuration of this inner wall face 19 is that it does not project at any point within an (imaginary) cone K whose axis is the longitudinal axis A of the shank and whose tip $K_1$ lies in first transverse plane $Q_1$ while the tip angle $\beta$, measured in degrees, is larger than a value calculated according to the formula $$-39+75\times\lg(D),$$

(D = maximum diameter, in millimeters, of first section $Z_1$).

I claim:

1. Lyophilization stopper made of a rubber elastic material and composed of a shank intended for insertion into the container neck to be sealed and of an essentially circular disc shaped flange which is made in one piece with the shank and projects radially beyond it, with the longitudinal axis of the flange being congruent with the longitudinal axis of the shank; the shank includes a cavity which surrounds the longitudinal axis of the shank, is open toward the free end face of the shank and extends up to a centrally closed wall portion of the flange; over its axial length, the shank includes a first section which extends between a first transverse plane defined by the boundary face of the flange projecting radially outwardly from the shank and a second transverse plane perpendicular to the longitudinal axis of the shank; this first section has a closed outer circumferential face whose maximum diameter is slightly larger than the inner diameter of the container neck; following the first section, the shank has a second section having an outer enveloping face which has essentially the same diameter as the first section and includes at least one passage communicating with a cavity extending from the end face of the shank to a radial opening disposed in the second section adjacent the second transverse plane; a plurality of blocking elements, which can be pushed back by elastic deformation, project outwardly from the second section beyond the enveloping face, with their axially outer boundaries lying on a common third transverse plane perpendicular to the longitudinal axis of the shank and disposed between the second transverse plane and the free end face of the shank perpendicularly to the longitudinal axis of the shank, characterized in that the inner wall face (19) laterally defining the cavity (4) lies entirely outside a cone (K) whose axis is the longitudinal axis (A) of the shank, whose tip ($K_1$) lies in the first transverse plane ($Q_1$) and whose tip angle ($\beta$), in degrees, is larger than a value calculated according to the formula $$-39+75\times\lg(D),$$

where "lg" in the formula represents the decimal logarithm and "D" the maximum diameter (D), measured in millimeters, of the first section ($Z_1$) of the shank (1).

2. Lyophilization stopper according to claim 1, characterized in that the inner wall face (6) of the central wall section (**2*b*) of the flange (2) axially delimiting the cavity (4**) is essentially planar in a surface region surrounding the longitudinal axis (A) of the shank and said surface region lies in a transverse plane (P) which is perpendicular to the longitudinal axis of the shank and extends near the first transverse plane ($Q_1$).

3. Lyophilization stopper according to claim 2, characterized in that the axially delimiting inner wall face (6) is offset relative to the transverse plane ($Q_1$) in the direction toward the outer face (7) of the central wall section (**2*b***).

4. Lyophilization stopper according to claim 2, characterized in that the inner wall face (19) laterally delimiting the cavity (4) begins at the surface region surrounding the longitudinal axis (A) of the shank, with its diameter becoming larger with increasing approach to the free end face (3) of the shank.

5. Lyophilization stopper according to claim 1, characterized in that the surface region of the outer face (7) of the central wall portion (**2*b*) of the flange (2) where it surrounds the longitudinal axis (A) of the shank is delimited against the remaining peripheral surface region by a circular arrangement of projections (8**) concentric with respect to the longitudinal axis (A) of the shank.

6. Lyophilization stopper according to claim 1, characterized in that the surface region of the outer face (7) of the central wall portion (**2*b*) of the flange (2**) where it surrounds the longitudinal axis (A) of the shank is made deeper than the remaining peripheral surface region.

7. Lyophilization stopper according to claim 3, characterized in that the inner wall face (19) laterally delimiting the cavity (4) begins at the surface region surrounding the longitudinal axis (A) of the shank, with its diameter becoming larger with increasing approach to the free end face (3) of the shank.

* * * * *